US006620246B2

(12) United States Patent
Alaimo et al.

(10) Patent No.: US 6,620,246 B2
(45) Date of Patent: Sep. 16, 2003

(54) PROCESS CONTROLLER FOR COATING FASTENERS

(75) Inventors: Gregory Alaimo, Harrison Township, MI (US); Raymond Oleskie, Jr., Utica, MI (US)

(73) Assignee: Nylok Corporation, Macomb, MI (US)

( * ) Notice: Subject to any disclaimer, the term of this patent is extended or adjusted under 35 U.S.C. 154(b) by 0 days.

(21) Appl. No.: 09/881,551

(22) Filed: Jun. 14, 2001

(65) Prior Publication Data

US 2002/0189540 A1 Dec. 19, 2002

(51) Int. Cl.[7] ..... B05C 11/10

(52) U.S. Cl. ..... 118/681; 118/695; 118/696; 118/713

(58) Field of Search ..... 118/663, 676, 118/689, 691, 692, 712, 713, 695, 696, 679, 680, 681, 682, 683, 684, 685

(56) References Cited

U.S. PATENT DOCUMENTS

| | | | | |
|---|---|---|---|---|
| 3,743,360 A | | 7/1973 | Brevko et al. | |
| 5,168,304 A | * | 12/1992 | Hattori | 355/50 |
| 5,221,170 A | | 6/1993 | Duffy et al. | |
| 5,287,061 A | | 2/1994 | Dechene et al. | |
| 5,362,327 A | | 11/1994 | Sessa et al. | |
| 5,448,172 A | | 9/1995 | Dechene et al. | |
| 5,711,989 A | | 1/1998 | Ciardella et al. | |
| 5,752,788 A | * | 5/1998 | Crum | 406/109 |
| RE35,883 E | * | 9/1998 | Konieczynski | 239/3 |
| 5,800,867 A | * | 9/1998 | Matsunaga et al. | 427/236 |
| 6,114,705 A | | 9/2000 | Leavitt et al. | |
| 6,122,439 A | * | 9/2000 | Gronet et al. | 219/390 |
| 6,170,973 B1 | | 1/2001 | Benedict | |
| 6,172,748 B1 | | 1/2001 | Sones et al. | |
| 6,175,652 B1 | | 1/2001 | Jacobson et al. | |
| 6,176,438 B1 | * | 1/2001 | Sato et al. | 222/571 |
| 6,208,772 B1 | | 3/2001 | Wilt et al. | |
| 6,228,169 B1 | * | 5/2001 | Wallace | 118/300 |
| 6,268,013 B1 | * | 7/2001 | Akimoto et al. | 118/52 |
| 6,298,149 B1 | * | 10/2001 | Nichani et al. | 382/149 |
| 6,391,111 B1 | * | 5/2002 | Fujimoto et al. | 118/320 |

OTHER PUBLICATIONS

European Search Report dated Oct. 31, 2002—Application No. 02394071.1–2422.

* cited by examiner

*Primary Examiner*—Richard Crispino
*Assistant Examiner*—George R Koch, III
(74) *Attorney, Agent, or Firm*—Niro, Scavone, Haller & Niro

(57) ABSTRACT

A process controller and method employing a machine vision system for automatically and continuously monitoring and controlling the processing of coated fasteners, and for separating the fasteners into three groups of "good", "rejected" and "purge"/recyclable parts.

25 Claims, 9 Drawing Sheets

PROCESS CONTROLLER FOR COATING FASTENERS

BACKGROUND OF THE INVENTION

The invention generally relates to a process for continuously monitoring and controlling various fastener coating processes, which may include but are not limited to processes involving loading and handling of bulk parts, vibratory sorting, heating, coating (powder or liquid) application to fasteners, tumbling, material recycling and curing ("fastener coating machines and processes").

A variety of fastener coating machines and processes are known for handling threaded fasteners (e.g., nuts and bolts) and non-threaded fasteners (e.g., rivets), and for coating them with a polymeric resin for various purposes, as disclosed in the following U.S. Patents, each of which is assigned to the present assignee and each of which is incorporated by reference herein: U.S. Pat. Nos. 4,060,868; 4,120,993; 4,801,043; 4,888,214; Re. 33,766; 5,236,505; 5,362,327; 5,403,624; 5,620,741; 5,685,680; 5,718,945; 5,758,798; 5,792,512; 5,908,155; 6,004,627; 6,017,391; 6,156,392; 6,168,662 B1; 6,209,758 B1; and 6,223,953 B1.

While these fastener coating machines and processes have proven useful, a fairly high degree of operator control has been required. It would be advantageous, therefore, to automate the processes, rendering them materially faster and more efficient, while also substantially enhancing quality control. Doing so requires resolution of various problems, and combining various designs and technologies, as discussed below.

To provide a few examples, various subsystems must be ready and properly operating for use with a typical fastener coating machine. Such subsystems include those supplying electricity, compressed air, and process heat to a machine. Subsystems for supplying the fasteners and also for supplying the coating material must also be available, e.g., filled reservoirs, free and unblocked feed tubes, etc. Heating coils, for example, must be powered, conveyors or turntables on dial machines must be powered and moving, and vacuum pressure must be available for coating reclamation. If one or more of these subsystems fail, attempted fastener processing can result in defective and unusable parts or damaged machinery. As an example, if a machine conveyor stalls for some reason, such as a defective motor, continuous heating of parts positioned within the induction heating coil will result in a fire, and destroy the induction heating track.

As another example, when a fastener processing machine first begins to run, the fasteners may not have time to reach the specified target temperature before entering the powder application zone. Since such fasteners, called "purged" fasteners, may not receive a properly adhering coating, it would be advantageous to purge these fasteners from the process before any coatings are applied.

Also, temperature control is critical to obtaining a proper coating, but its regulation and maintenance may be limited to an operator's subjective view of the "color change" in the fasteners. As another example, the continuous availability of compressed air (as opposed to its use only when needed) with various fastener machines, disclosed in the patents recited above, increases utility costs and noise levels.

As a further example, coated fasteners must be inspected for quality control. Manual inspection requires the presence of an operator, limits processing speed, and is also dependent on variable parameters such as operator fatigue.

As a still further example, coating reclamation (e.g., using vacuum procedures to reclaim oversprayed coating material), particularly if done manually, may also interrupt fastener processing.

Each of these problems may be minimized or eliminated using automated processing provided by the present invention, as described below.

One aspect of the present invention incorporates the use of a machine vision system. Machine vision systems are known for monitoring and controlling various processes. See, e.g., U.S. Pat. Nos. 6,114,705; 6,172,748 B1; 6,175,652 B1; 6,170,973 B1; and 6,208,772 B1, each of which is incorporated by reference herein. A machine vision system typically provides automated, computer-based image acquisition and analysis capabilities, that can be employed for tasks such as measurement and inspection of fastener components or materials. A machine vision system employs a camera for acquiring an image of an object, and functionality for processing the acquired image and providing desired information about the fasteners as they are coated.

Accordingly, it is an object of the present invention to provide an automated system for processing the coating of fasteners.

It is another object of the invention to provide such a system which is capable of being retrofitted onto existing fastener processing machines.

It is another object to provide processing controls, including a processing controller incorporating the use of a programmable logic controller and a machine vision system, designed and configured to automatically and remotely control the processing of various types of fastener processing machines.

Definition of Claim Terms

The following terms are used in the claims of the patent as filed and are intended to have their broadest meaning consistent with the requirements of law. Where alternative meanings are possible, the broadest meaning is intended. All words used in the claims are intended to be used in the normal, customary usage of grammar and the English language.

"Fastener" means threaded parts (e.g., nuts and bolts) as well as non-threaded parts (e.g., rivets) coated with a polymeric resin in either liquid or powder form, using the invention.

"Fastener conditions" means predetermined condition(s) to be monitored by the process controller of the present invention, such as but not limited to the number of threads on the fasteners, the orientation of the threads on the fasteners, or the orientation of the fasteners.

"Machine vision system" means a system which acquires an image and processes that image in order to evaluate predetermined variables, parameters or criteria with regard to fasteners being processed using the invention.

"Predetermined criteria" means predetermined parameters or variables to be monitored by the process controller of the invention concerning fasteners to be properly processed, including fastener conditions as well as other conditions, such as the amount of coating coverage on the fasteners, the location of coating on the fasteners, etc.

"Rejected fasteners" means fasteners which do not meet the predetermined process criteria necessary for qualifying a processed fastener as a "good" part (e.g., appropriate number of threads, appropriate coating coverage).

"Purged fasteners" means fasteners which are purged, or removed, from the production process during machine startup and shutdown cycles. Purged fasteners may (or may not) have been previously heated. However, purged fasteners have never been subjected to application of a coating and, therefore, may be recycled by the processing equipment.

"Good fasteners" means fasteners which meet the predetermined process criteria.

SUMMARY OF THE INVENTION

The objects mentioned above, as well as other objects, are solved by the present invention, which overcomes disadvantages of prior art process controllers, while providing new advantages not previously obtainable.

In a preferred embodiment, a process controller is provided for monitoring and controlling processing steps involving the application of polymeric resin coatings onto fasteners using processing steps based on predetermined criteria. The fasteners may move or be moved along a pathway located on, or adjacent to, a coating work station. During processing, the process controller automatically performs each of the following mentioned steps. First, an initiation sequence may be performed which confirms the availability of one or more subsystems supplying one or more of the following preconditions: compressed air, heat for use in coating the fasteners, vacuum pressure for a powder coating reclamation system, and presence of sufficient coating material. The heat for use in coating the fasteners may be provided by an induction coil, infrared rays or other heating mechanisms such as those providing conductive heat. The process controller may, but need not, selectively control the presence of compressed air using an air solenoid.

After confirming the availability of one or more of the preconditions, control signals may be initiated to actuate one or more of the subsystems supplying one or more of the preconditions. During fastener processing, one or more of the following run conditions may be continuously monitored for a negative run condition, which may result in the processing of fasteners not meeting the predetermined criteria: fastener speed along the pathway within a predetermined range, coating flow, and heating within a predetermined temperature range. Temperature sensing may, but need not, be accomplished using an optical pyrometer. Also during fastener processing, one or more of the following preselected fastener conditions may be continuously monitored for a defective fastener condition using a machine vision system in communication with the process controller: the number of threads on the fastener, the location of threads on the fastener, the orientation or pitch of the threads on the fastener, the amount of coating coverage on the fastener, and the location of coating on the fastener. Upon detecting a negative run condition, processing may be automatically stopped and the cause of the negative run condition may be indicated. Upon detecting a defective fastener condition, processing may be continued and the detected fastener may be directed to a preselected location for defective fasteners.

In a particularly preferred embodiment, the machine vision system may include a camera and a light source, which may but need not include a fiber optic cable and a halogen bulb. Preferably, the light source illuminates the particular fastener with an illumination power substantially greater than illumination provided by ambient light surrounding the particular fastener. Preferably, the light source provides a substantially constant illumination power over the useful life of the light source.

In one embodiment, the movable pathway is a turntable on a dial machine. Preferably, the turntable is rotated and its speed regulated by a closed loop control system. The closed loop control system may include a motor, a tachometer, and an electronic motor drive. In another embodiment, the pathway may be a belt conveyor.

If the coating material is a liquid, its presence within a delivery tube may be sensed using one or more electronic optical, pressure, or flow sensors. If the coating material is a powder, its presence may be sensed using a capacitive sensor and/or a triboelectric flow monitor.

Preferably, the process controller directs fasteners to be separated into at least three locations: a first location comprising Purged fasteners which have not been coated and which may be recycled for processing; a second location comprising Rejected fasteners which have been found to have a defective fastener condition; and a third location comprising Good fasteners that have been properly processed and meet the predetermined criteria.

Preferably, the process controller provides a visual and/or audible signal indicating the presence of at least one of the following conditions: (1) a major system fault resulting in ceasing of processing; (2) a minor system fault allowing continued processing; and (3) normal processing conditions.

BRIEF DESCRIPTION OF THE DRAWINGS

The novel features which are characteristic of the invention are set forth in the appended claims. The invention itself, however, together with further objects and attendant advantages thereof, will be best understood by reference to the following description of various preferred embodiments taken in connection with the accompanying drawings, in which:

FIGS. 3 and 8 are exploded views of the monitor displays on the front door of the process controller, as seen in FIG. 1;

DETAILED DESCRIPTION OF THE PREFERRED EMBODIMENTS

Set forth below is a description of what are currently believed to be the preferred embodiments and/or best examples of the invention claimed. Present and future alternatives and modifications to these preferred embodiments are contemplated. Any alternatives, or modifications, which make insubstantial changes in function, in purpose, in structure or in result are intended to be covered by the claims of this patent.

Figure 1:
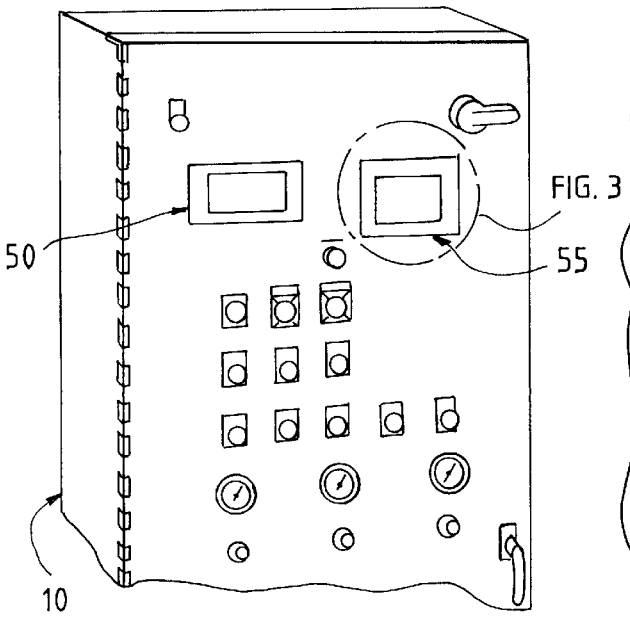
FIG. 1 is a partial perspective front view of a preferred embodiment of the process controller of the present invention.
Figure 2:
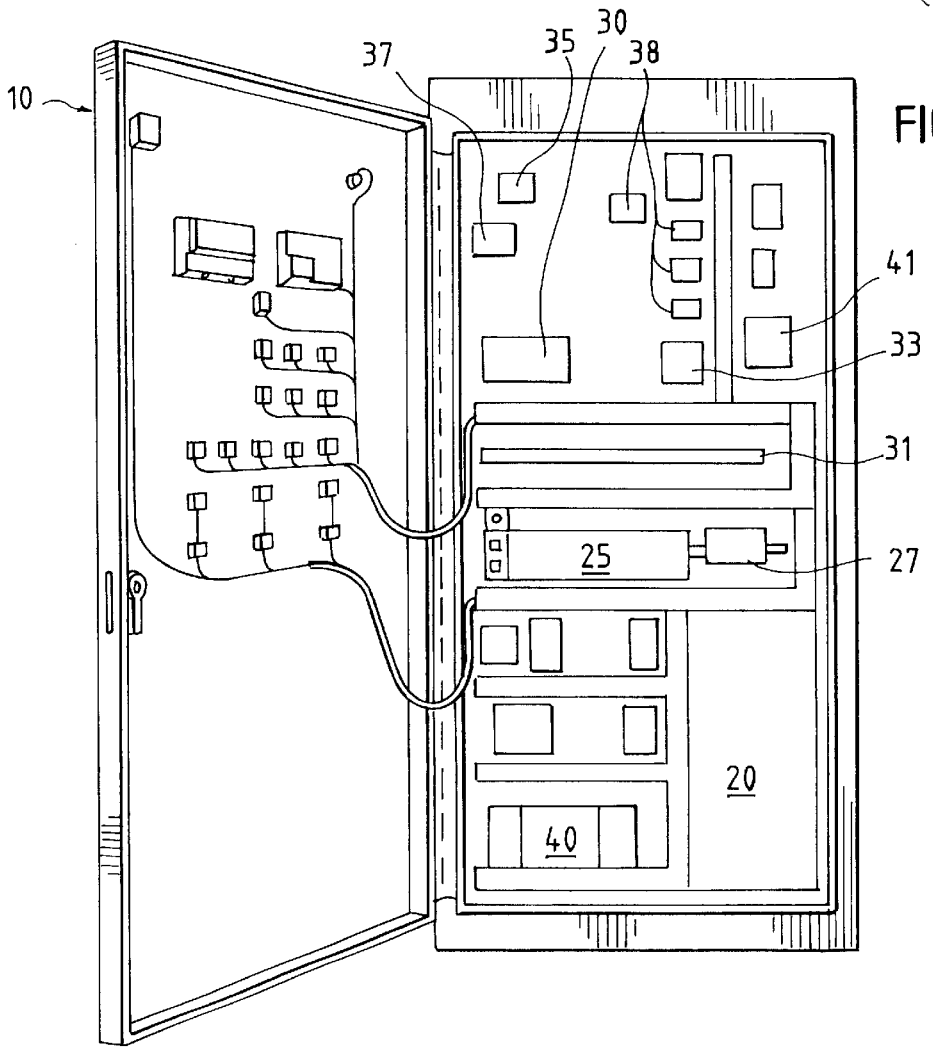
FIG. 2 is a perspective front view of a preferred embodiment of the process controller of the present invention, with the door open.
Figure 4:
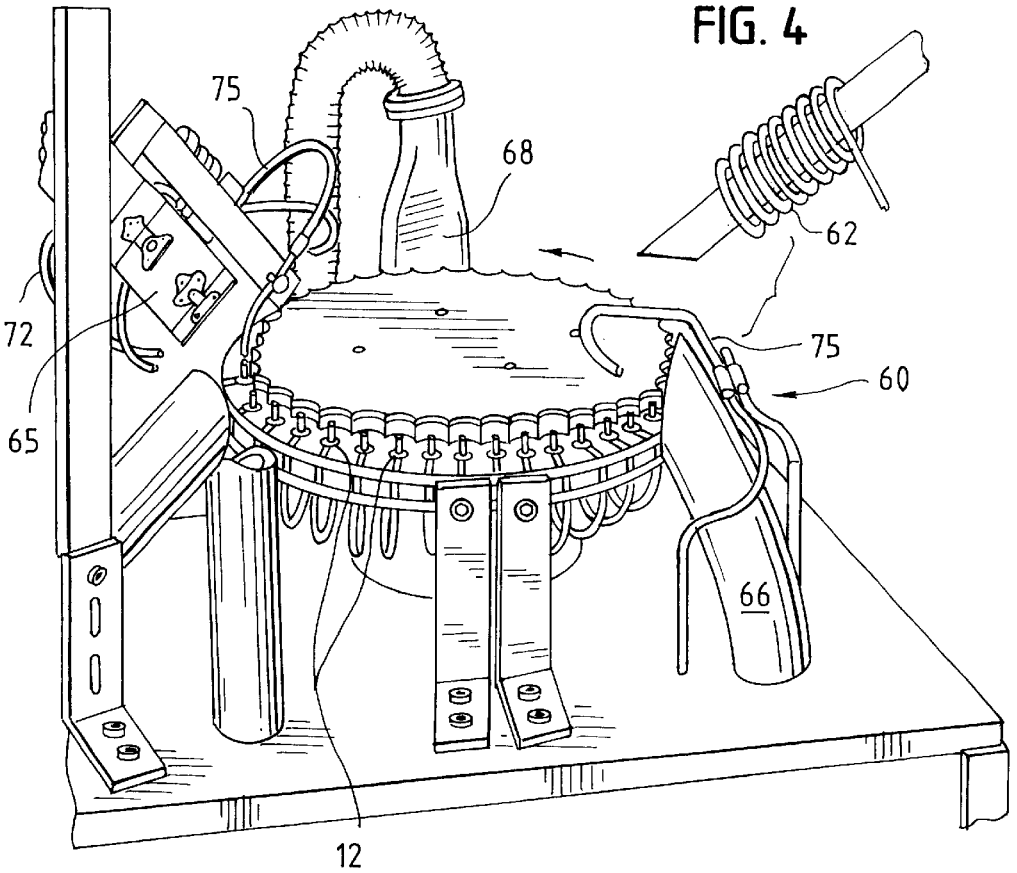
FIGS. 4 and 5 are perspective side and top views from different angles of a preferred dial machine for use with the present invention.
Figure 5:
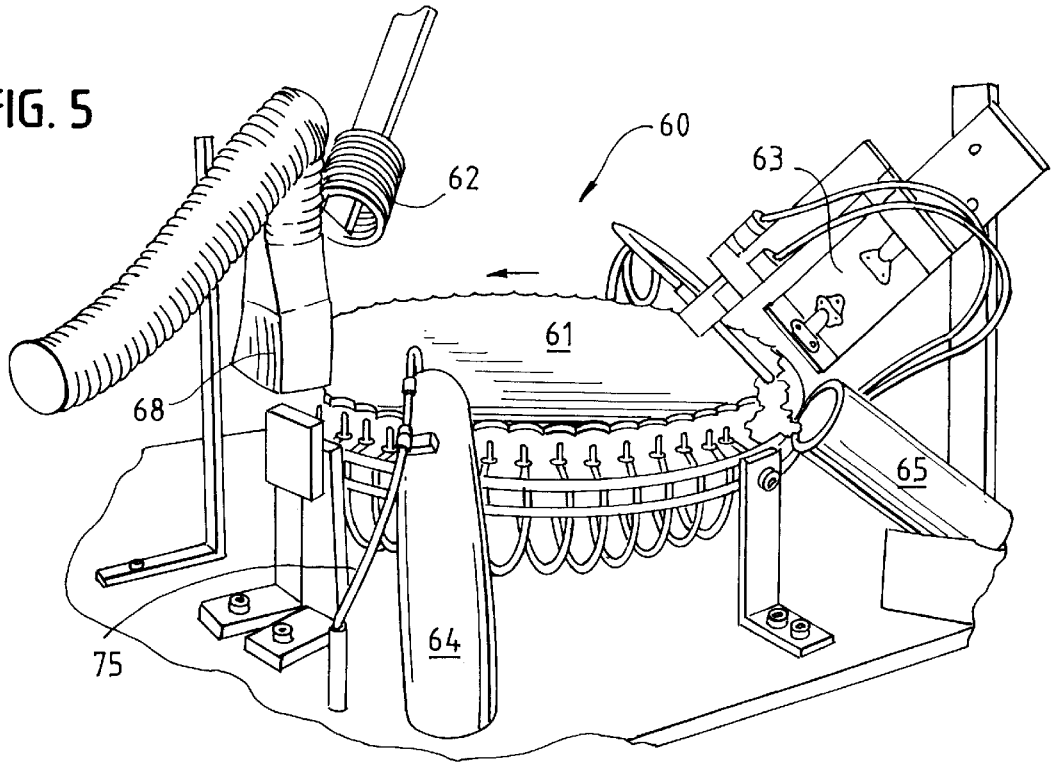
Figure 6:
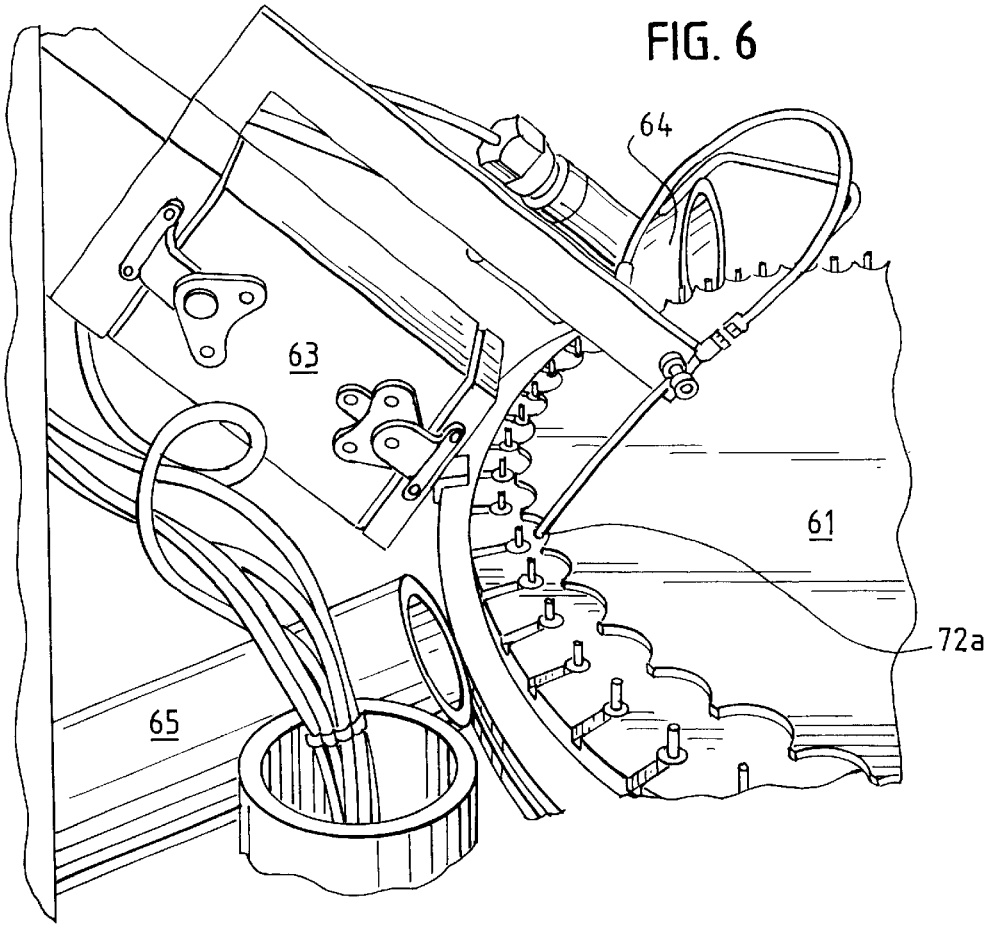
FIG. 6 is an exploded view of a portion of the dial machine shown in FIGS. 4 and 5, illustrating a camera and light source used with a preferred embodiment of the machine vision system of the present invention.
Figure 7:
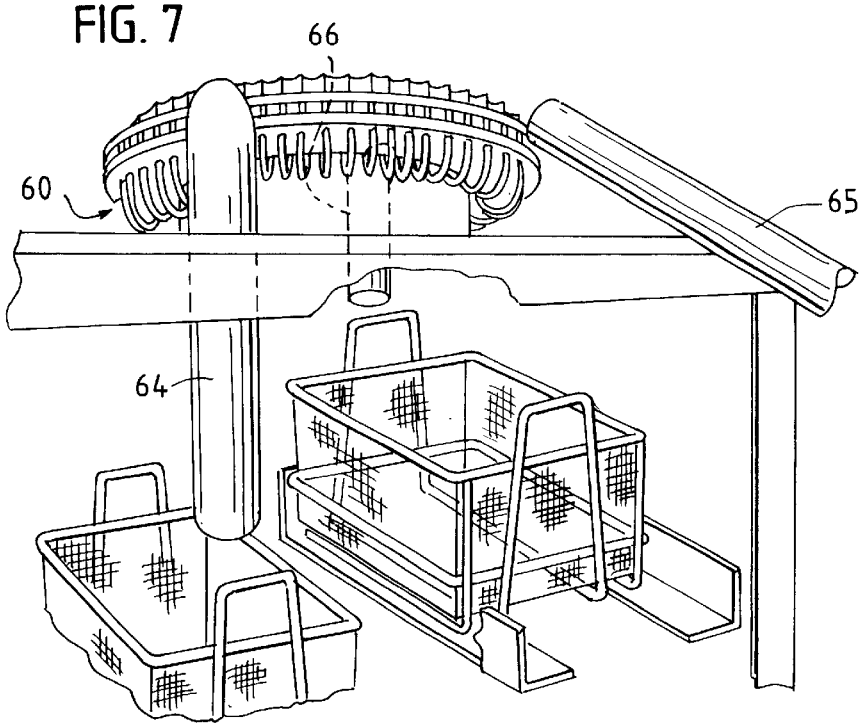
FIG. 7 is a perspective front and bottom view of the dial machine shown in FIGS. 4–6, illustrating the conduits leading to storage bins housing purged and defective fasteners.

Referring to FIGS. 1–2, the process controller is generally designated as 10. Process controller 10 enables the automatic and sequential start-up and shut-down of one or more fastener coating machines and/or subsystems for such machines.

Referring now to FIG. 2, in a preferred embodiment, process controller 10 includes: a fiber optic light source 20; a programmable logic controller (PLC) 25; a camera controller 27 which may accommodate color or gray scale data acquisition; external and internal terminal strips 30, 31 for accommodating wiring for conveyors, motors, etc.; a vacuum switch 33 for monitoring a remote powder collection system; a DC power supply 40; a pressure switch 35 for sensing the presence of compressed air; a main air solenoid 37 for supplying compressed air to the fastener machines; and various other solenoids 38 for supplying air to a Rejected fasteners air ejector, a Purged fasteners air ejector, and a powder pump. Line filter 41 may be used to prevent electrical noise from entering process controller 10 via the electrical power line. A particularly preferred process controller 10 includes an interactive display (24 V DC 10 W source), a programmable logic controller (PLC, e.g., Model CQM1), a PLC CPU unit (24 V DC input, e.g., Model CQM1H-CPU51), and a power supply (24 V DC), each available from Omron Corporation of Japan.

Figure 3:
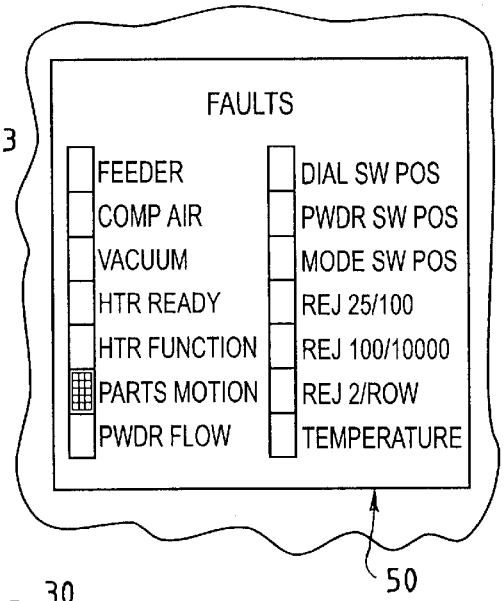

Referring to FIGS. 1 and 3, a typical display screen 50, which may preferably constitute a touch screen display, may show the state of readiness of various fastener processing systems, including: a parts feeder ("Feeder"); compressed air ("Comp. Air"); vacuum pressure for powder coating reclamation ("Vacuum"); heater readiness and heater functioning ("HTR Ready", "HTR Funct."); fastener conveyors being operable ("Parts Motion"); powder flow ("Pwdr. Flow"); dial switch position ("Dial SW Pos"); and mode switch position (Mode SW Pos").

Referring now to FIGS. 4–7, a dial machine 60 for coating internally threaded fasteners is shown. Dial machine 60 has a horizontally rotating turntable 61 controlled by process controller 10, and includes induction heating coil 62. Following heating, a coating is applied using an appropriate coating applicator such as spray nozzles 12 which are evenly spaced around dial machine 60. A powder collection "horn" 68 removes excess powder from the spray zone, and directs this powder back to a dust collection system (not shown).

Referring to FIGS. 4–7, various ejector tubes for accommodating fasteners may include a "purge" ejector tube 64 for conveying parts to a recycling location, a "defective parts" ejector tube 66 for conveying parts to a defective parts bin, and a "good parts" ejector tube 65 for conveying properly coated parts to a cooling location. Fasteners may be selectively ejected from the turntable track using bursts of compressed air from tubes 75.

Still referring to FIGS. 4–7, a camera housing 63 is provided for conveying video images to the process controller 10. A suitable camera trigger, such as a cam follower proximity switch located on the coating machine, may be used with the camera and camera controller. Preferably, the object field of the camera is bathed with high intensity light emitted from the discharge end of the fiber optic light conduit 72, which also is also housed within camera housing 63. This light preferably is of such a high intensity that it "swamps" ambient light, ensuring that variations in ambient light do not distort data acquisition by the machine vision system. Most preferably, a light source is used which maintains a constant light emitting power, rather than one whose light emitting power diminishes over use; this, again, ensures that data acquisition and processing will not be distorted by a changing light source. A preferred light source is a halogen 3900 Lightsource Smart-Lite™, available from Illumination Technologies of Syracuse, N.Y., whose long-term light power output change is less than 1%.

While the preferred vision system of the present invention utilizes a fiber optic cable and a halogen bulb, vision systems according to the invention need not use these features, but may instead utilize less expensive components such as LED solid state light sources, as now commonly used.

A suitable machine vision system, which may be used with process controller 10 of the present invention is available from Omron Corporation of Japan, e.g. Model F-150-2. The machine vision system may be programmed to monitor various predetermined criteria, such as: proper coating coverage (e.g., using lightness/darkness parameters on a 0–255 greyscale black/white shade range for each pixel, or suitable color criteria for colored coatings); proper thread number and/or orientation and/or pitch; proper fastener orientation; and proper powder and liquid deposition and quantity.

Figure 8A:
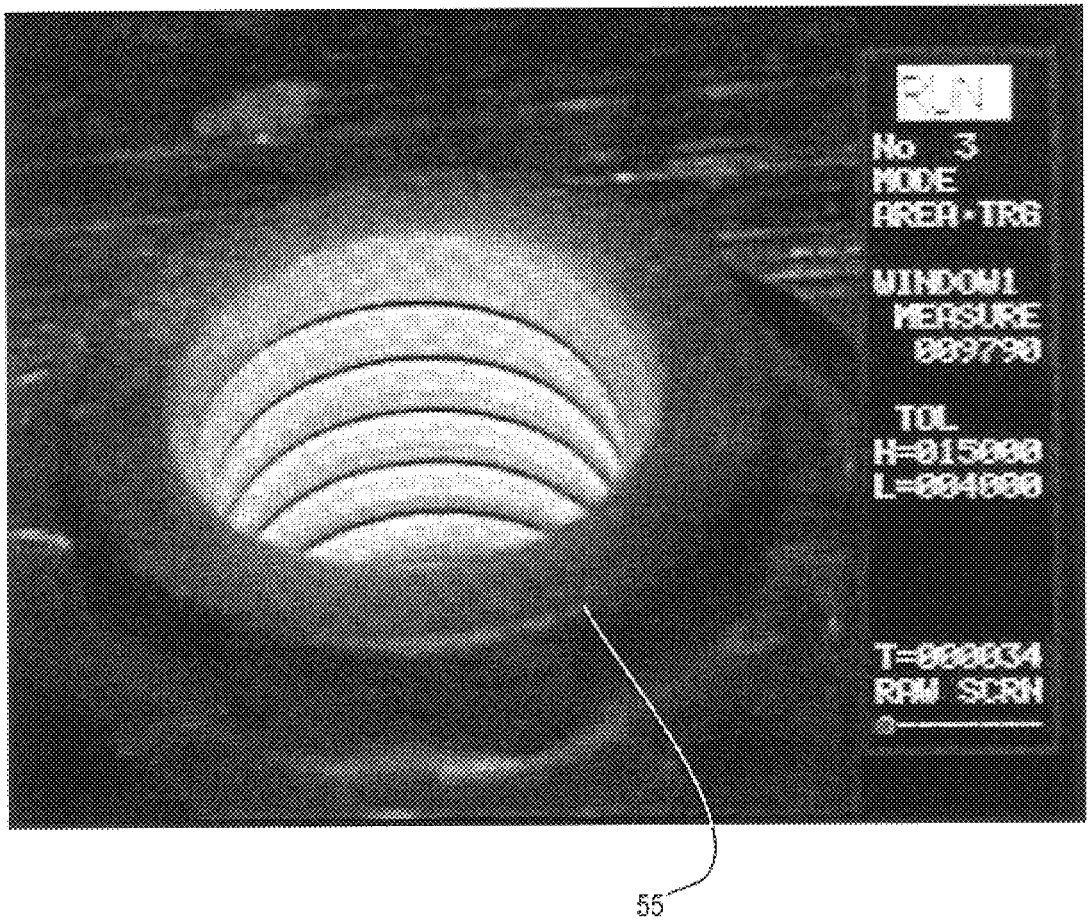
FIGS. 8*a* and 8*b* are video images captured by a preferred embodiment of the vision system of the present invention, and, showing top and bottom views of an internally threaded fastener following coating application.
Figure 8B:
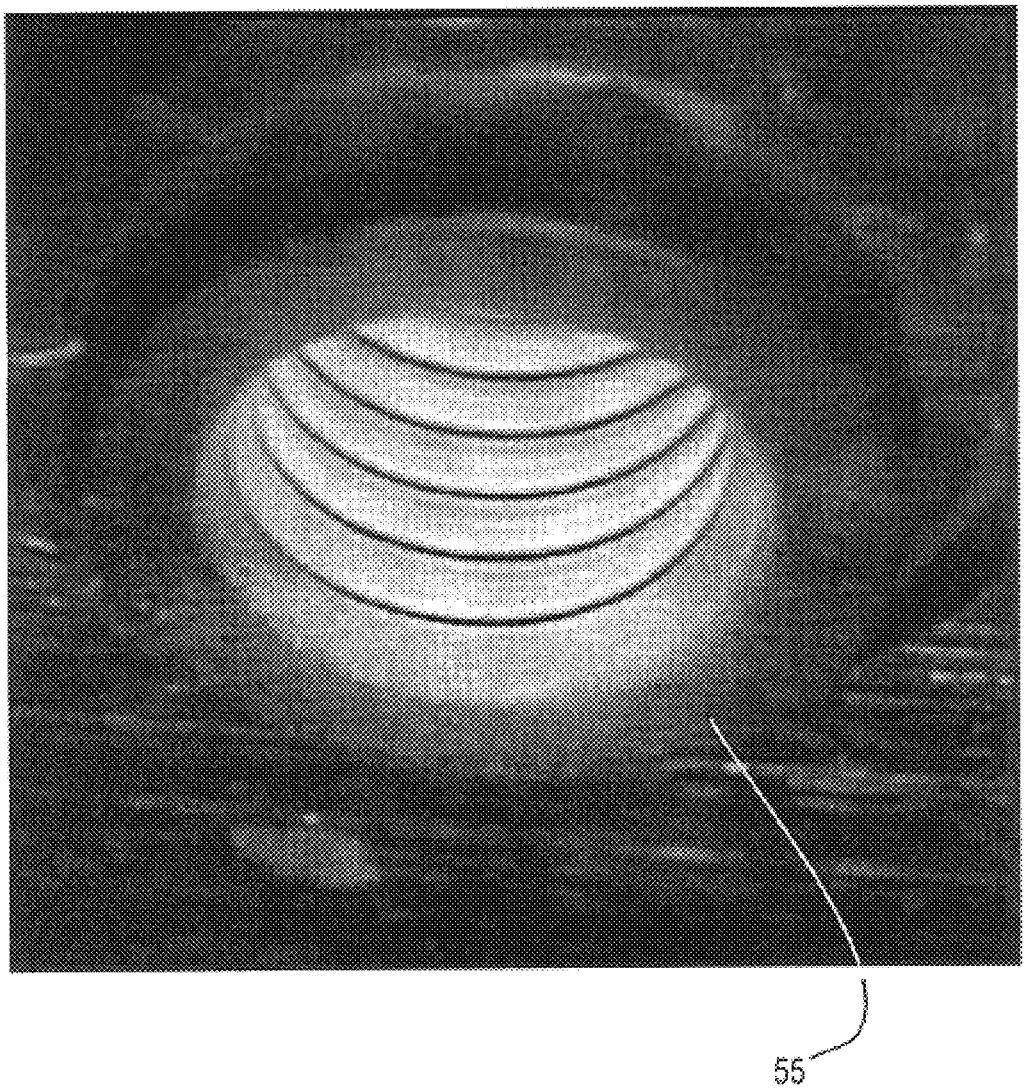

Referring to FIGS. 8*a* and 8*b*, monitor 55 of process controller 10, shown in FIG. 1, may display video images captured by the camera, together with the grid or zone selected for inspection. Monitor 55 preferably permits manual operator setup, programming, and evaluation of the inspected parameters. Thus, monitor 55 may show the fastener orientation, coating coverage (using black and white shading differences) or other parameters. Error indicators may be used to show the reason why a particular defective part was rejected (e.g., coating coverage, faulty number of threads, etc.).

Various advantages flow from the use of the present invention, some of which are now described. Using main air solenoid 37 of the process controller, compressed air is only supplied when needed, as directed by controller 10. This reduces noise, compressed air consumption, and electrical power requirements. Using appropriate heat sensors, such as an optical pyrometer available from Ircon, Inc. of Niles, Ill., a temperature gauge for monitoring the process heat of the fasteners may be provided, as well as a visual, LED display of temperature. If the process temperature does not reach a desired operating range, or if a failure of the heating source is detected, controller 10 may be programmed to shut down the process and display the corresponding system fault.

Process controller 10 may also require machine shutdown if an appropriately located proximity switch or other motion sensor fails to detect the presence and/or movement of conveyed parts. For detecting moving fasteners, a variety of commonly available sensors may be used, including inductive proximity sensors for sensing metal, capacitive sensors for sensing material density, or photoelectric sensors.

Closed loop speed controls are preferably used with the fastener coating machines and systems of the present invention. For use with a dial machine, for example, a tachometer may be built onto the motor (e.g., a standard Baldor motor), so that the motor automatically compensates for differences in heating and/or load, to ensure that the speed that is set is the speed that is actually achieved. A properly sized motor, when equipped with a tachometer and matched to a suitable electronic motor drive, will ensure high torque and accurate speed regulation.

Various types of level sensors (inductive, capacitive, or photoelectic) may be used to verify that coating materials are available from bulk delivery sources, such as bulk hoppers, screw feeders or liquid reservoirs. Additionally, suitable flow sensors may be used for verification of adequate powder or liquid material flow to the application process.

Preferably, different sensors are employed for sensing powder or liquid coatings. For example, suitable powder flow monitors include cross-correlating sensors, such as those available from Endress Hauser of Greenwood, Ind., or triboelectric flow monitors such as those available from Auburn International Inc. Danvers, Mass., as disclosed in U.S. Pat. Nos. 5,448,172 and 5,287,061, incorporated herein by reference.

There are a variety of suitable liquid flow monitors or detectors, which can sense the presence or flow of liquid by using color detectors or photocells (e.g., many liquid coatings are brightly colored, which clearly shows within a clear tube). A variety of pressure and flow switches, detectors, and instrumentation, may also be used for this purpose.

The process controller preferably insures that coatings are not applied to "Purged" fasteners (e.g., parts passing through an induction heating coil system before attaining a suitable process power or temperature), since the coating material may not properly adhere. Using the present invention, uncoated purged parts, then, may be advantageously recycled by being passed or shunted to a separate recycle bin.

Each process controller 10 is provided with the capability of interfacing with one or more different fastener coating machines. The input/output capability of the PLC is designed to be sufficient for this purpose, while also minimizing operator interactions.

Preferably all purchased electrical components used with the process controller of the present invention meet the requirements of various country testing requirements, including UL (Underwriters Labs), CE (European equivalent of UL) and CSA (Canadian Standards Association).

Using the particularly preferred embodiment of process controller 10 disclosed here, a number of inputs may be provided to the PLC: (1) An operator commences the processing of fasteners by initiating a "cycle start" signal; (2) an air pressure sensor switch verifies the presence of shop air-pressure before the cycle is allowed to start; (3) a fastener infeed track motion sensor, such as a proximity switch, senses when parts are moving through the heater, e.g., induction coil; (4) the heater power is verified; (5) an optical pyrometer or other sensor monitors fastener temperature; (6) a powder or liquid flow sensor monitors material flow rate; (7) a level sensor (for screw feeders or liquid reservoirs, for example) verifies that coating materials are available from a bulk delivery source; (8) proximity switch functions as a source for the camera's trigger signal; (9) push buttons (e.g., "Reset 25" or "Reset 75") reset the error indicator after detecting a predetermined number of defective parts (e.g., 25/100 or 75/1000).

In the particularly preferred embodiment, output signals may be provided by PLC to accomplish the following: (1) an enable signal is provided to the main air solenoid, to supply compressed air to the system; (2) an enable signal is provided to the drive motor, to provide power to the fastener conveyor driver motor; (3) an enable signal is provided to the induction heater, to power the induction heater; (4) an enable signal is provided to the coating material application system, to supply powder or liquid; (5) a signal is provided to the air ejector solenoid to eject fasteners that are not sufficiently heated during the cycle start-up period; these purged fasteners may then be recycled rather than being considered as scrap; (6) an enable signal is provided to power/energize the liquid or powder flow monitor; (7) a red indicating light(s) is enabled to signal defective parts (e.g., 25/100 or 75/1000 LED); (8) a signal is provided to the air ejector solenoid to eject defective parts, as identified by the vision system; (9) counters/rate meters are signaled to increment when "good" or "defective" fasteners are detected; and (10) light towers are signaled to indicate "Major" system faults shutting down the processing system (red light), "Minor" system faults allowing continued processing (amber light), or normal processing conditions (green light).

Figure 9:
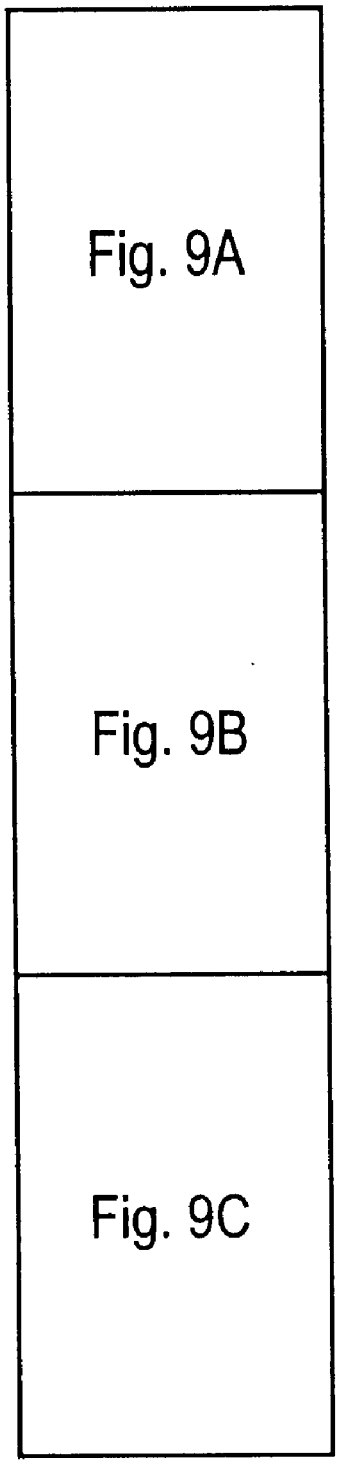
FIGS. 9, 9*a*, 9*b*, and 9*c* are flow diagrams illustrating the logical sequence of a particularly preferred process controller embodiment of the present invention.
Figure 9A:
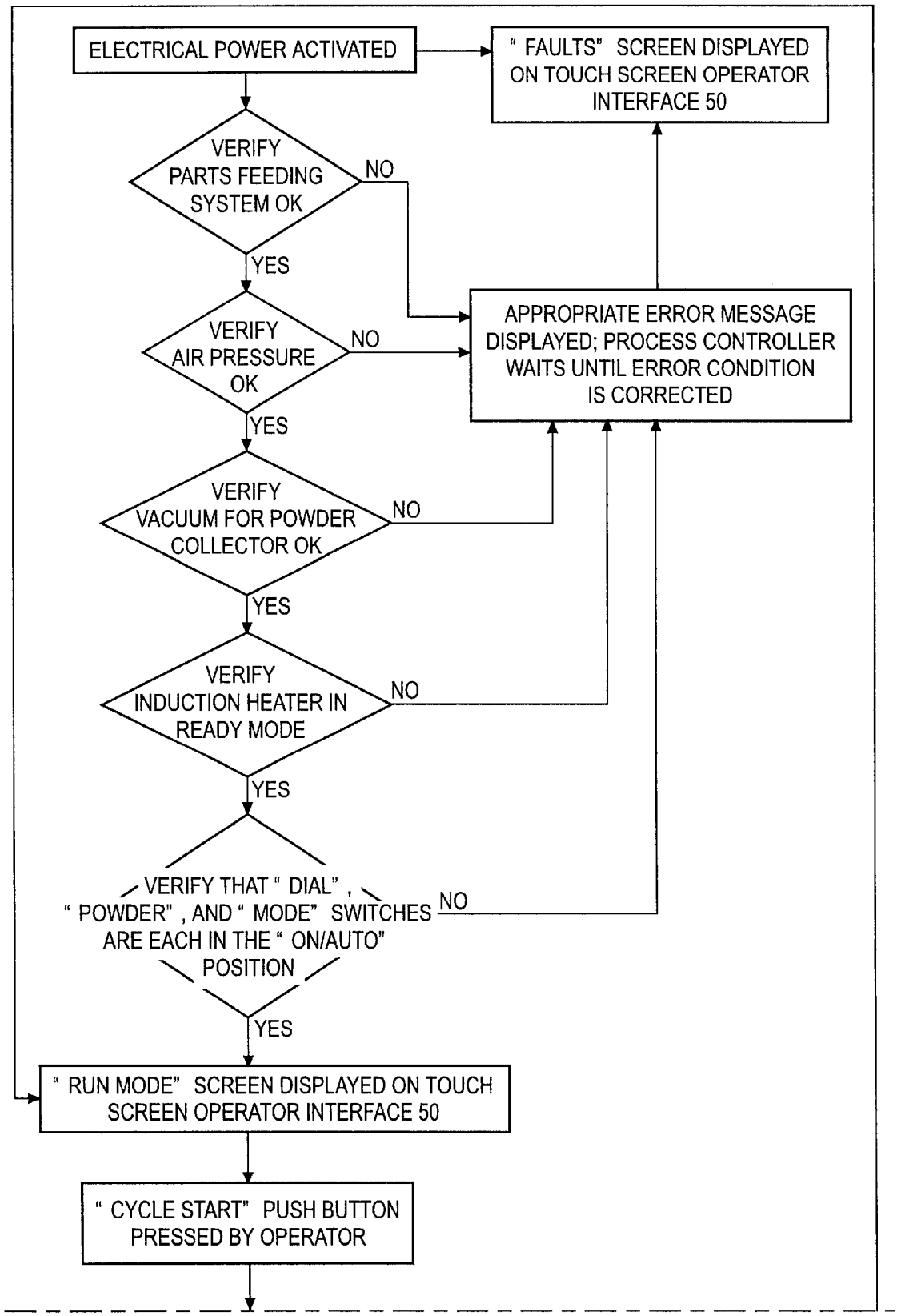
Figure 9B:
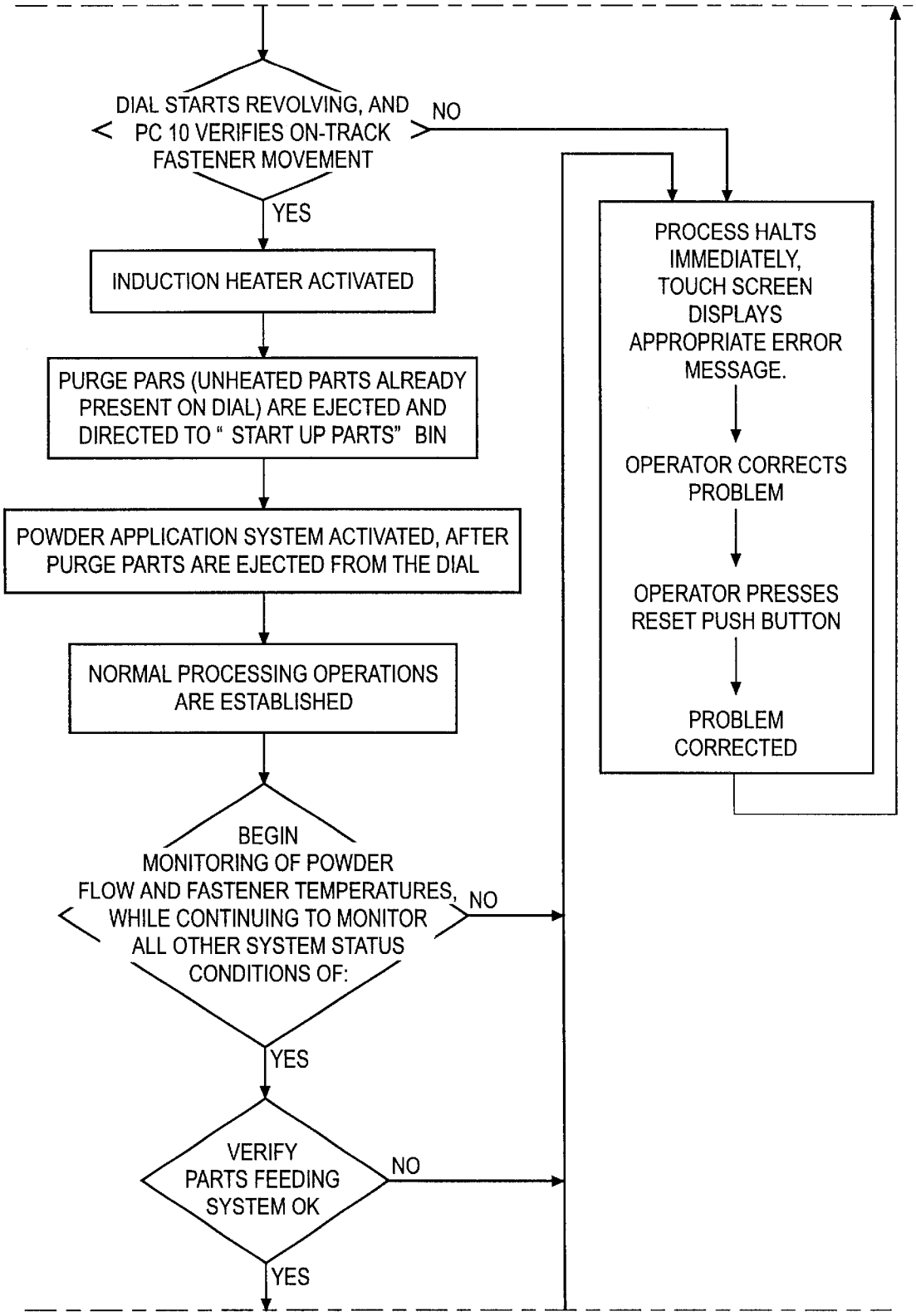
Figure 9C:
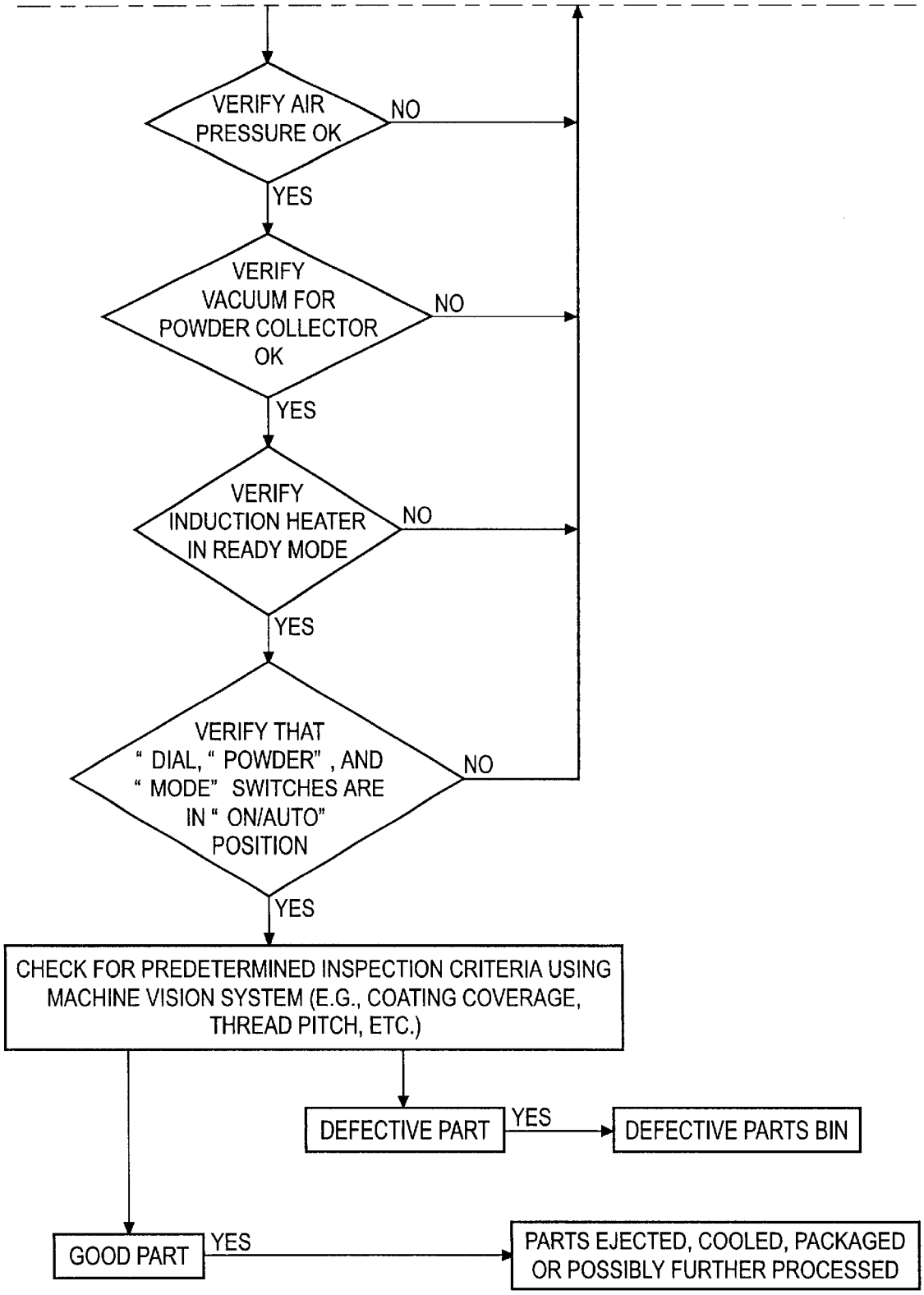

Referring to FIG. 9, the processing sequence shown for a preferred embodiment should now be understood. In overview, when electrical power is first applied to the process controller 10, the system will automatically perform a number of system tests, and a System Self-Test screen will be automatically displayed on touchscreen interface 50. When all system Self-Tests are successfully completed, the touchscreen will automatically display the Run Mode screen. Once normal operation has been established, if any major system fault should be detected, the system will automatically perform a controlled shut down, and the System Self-Test screen will, once again, be automatically displayed, clearly indicating the cause of the system shut down.

Suitable, well-known devices may be provided for operator safety. For example, a manually-operated fused electrical disconnect interlocked to the door of the control cabinet of process controller 10 may be provided, so that electrical power is removed upon opening of the door. Additionally, an immediate emergency shut-down of all energy-storage devices within the process (electrical, pneumatic, hydraulic, etc.) may be provided in the form of a single pushbutton or other actuator.

The above description is not intended to limit the meaning of the words used in the following claims that define the invention. Rather, it is contemplated that future modifications in structure, function or result will exist that are not substantial changes and that all such insubstantial changes in what is claimed are intended to be covered by the claims. For example, while the preferred embodiment shown in the drawings illustrates a dial machine, it will be readily understood that various fastener processing machines, including those machines disclosed in the patents incorporated herein by reference such as those using linear (e.g., belt conveyor) as well as rotary conveyors, may be advantageously used with the present invention.

We claim:

1. An apparatus to monitor and control the process of applying at least one coating material onto the threads of a fastener comprising:

a coating applicator adapted to apply at least one coating to a fastener;

a process controller adapted to perform an initiation sequence by receiving at least one input confirming the operability of at least one subsystem from the group comprising: compressed air, process heat, parts feed, vacuum pressure for coating reclamation, and coating material feed;

at least one control signal provide by said process controller to actuate operation of said at least one subsystem after said process controller confirms the operability of said at least one subsystem;

said process controller monitors operation of said at least one subsystem during fastener processing and in the event of a failure of said operation, said process controller provides a signal halting fastener processing;

said process controller monitors at least one run condition for conformance with at least one predetermined criteria, said run condition comprising at least one of the following: fastener speed, coating flow, and heating within a temperature range;

said process controller adapted to provide a signal halting fastener processing upon detecting a run condition which does not meet said predetermined criteria;

a machine vision system which is in communication with said process controller to monitor fasteners for conformance with a predetermined inspection criteria, said predetermined inspection criteria comprising at least one of the following: the number of threads on the fastener, the location of threads on the fastener, the orientation or pitch of the threads on the fastener, the amount of coating coverage on the fastener, and the location of coating on the fastener; and said process controller upon detecting a fastener which fails to meet said inspection criteria provides a signal which causes the detected fastener to be directed to a preselected location while allowing fastener processing to continue.

2. The apparatus of claim 1, wherein said machine vision system comprises a camera, a light source, and an image processor.

3. The apparatus of claim 1, wherein said light source has an illumination power substantially greater than illumination provided by surrounding ambient light.

4. The apparatus of claim 3, wherein said light source comprises a fiber optic cable and a halogen bulb.

5. The apparatus of claim 2, wherein said light source provides a substantially constant illumination power over the useful life of the light source.

6. The apparatus of claim 1, wherein said process heat for use in coating the fasteners is provided by a heating mechanism utilizing an induction coil.

7. The apparatus of claim 1, wherein said compressed air is controlled using an air solenoid.

8. The apparatus of claim 1, wherein said fasteners move along a pathway.

9. The apparatus of claim 8, wherein said pathway comprises a turntable on a dial machine.

10. The apparatus of claim 9, wherein said turntable is rotated and its speed regulated by a closed loop control system.

11. The apparatus of claim 10, wherein said closed loop control system comprises a motor, a tachometer, and an electronic motor drive.

12. The apparatus of claim 8, wherein said pathway comprises a belt conveyor.

13. The apparatus of claim 1, wherein the presence of said coating material is detected using one or more optical electronic sensors.

14. The apparatus of claim 1, wherein the presence of said coating material is detected using one or more pressure and/or flow switches.

15. The apparatus of claim 1, wherein the presence of said coating material is detected using a capacitive sensor.

16. The apparatus of claim 1, wherein the presence of said coating material is detected using a triboelectric flow monitor.

17. The apparatus of claim 1, wherein the process controller directs fasteners to be separated into at least three locations: a first location comprising purged fasteners which have not been coated and which may be recycled for processing; a second location comprising fasteners which fail to conform to said inspection criteria; and a third location for fasteners that meet said inspection criteria.

18. The apparatus of claim 1, wherein process heating is provided by an optical pyrometer.

19. The apparatus of claim 1, wherein the process controller provides a visual and/or audible signal indicating the presence of at least one of the following conditions: (1) a subsystem fault resulting in ceasation of processing; (2) a fault concerning said inspection criteria and allowing continued processing; and (3) normal processing conditions.

20. An apparatus to monitor and control the process of applying at least one coating material onto the threads of a fastener comprising:

a coating applicator adapted to apply at least one coating material to the threads of a fastener;

a process controller to confirm the availability of at least one subsystem from the group comprising: compressed air, parts feed, vacuum pressure for material reclamation, and coating material feed;

said process controller adapted to perform the following operational sequence to begin fastener processing upon confirming the availability of said at least one subsystem:

providing at least one control signal to activate the revolution of a dial and to begin purging fasteners, monitor for fastener movement on said dial, providing at least one control signal to activate process heat, providing at least one control signal to activate the application of coating material, and after purging a predetermined number of fasteners, providing at least one control signal to deactivate fastener purge;

said process controller adapted to monitor the availability of said at least one subsystem during fastener processing and in the event of said subsystem becoming unavailable, said process controller provides a signal halting fastener processing;

a machine vision system in communication with said process controller, said machine vision system adapted to monitor fasteners for conformance with predetermined inspection criteria, said predetermined inspection criteria comprising the number of threads on the fastener, the location of threads on the fastener, the orientation or pitch of the threads on the fastener, the amount of coating coverage on the fastener, and the location of coating on the fastener;

said process controller upon detecting a fastener which fails to meet said inspection criteria provides a signal which causes the detected fastener to be directed to a preselected location while allowing fastener processing to continue.

21. The apparatus of claim 20, wherein fasteners are separated into at least three locations: a first location for purged fasteners, a second location for fasteners which fail to conform to said inspection criteria; and a third location for fasteners meeting said inspection criteria.

22. The apparatus of claim 20, wherein said process controller provides a signal halting fastener processing when the number of fasteners failing to meet said inspection criteria exceeds a predetermined number.

23. An apparatus to monitor and control the process of applying at least one coating material onto the threads of a fastener comprising:

a coating applicator adapted to apply at least one coating material to the threads of a fastener;

a process controller adapted to confirm the availability of the following subsystems upon activation of electrical power and prior to fastener processing: compressed air, parts feed, and vacuum pressure for material reclamation;

said process controller performs the following operational sequence to begin fastener processing upon confirming the availability of said subsystems:

providing at least one control signal to activate the revolution of a dial and to begin purging fasteners, monitor for fastener movement on said dial, providing at least one control signal to activate process heat, providing at least one control signal to activate the application of coating material, and after purging a predetermined number of fasteners, providing at least one control signal to deactivate fastener purge;

said process controller monitors the availability of said subsystems during fastener processing and in the event of a subsystem becoming unavailable, said process controller provides a signal halting fastener processing;

a machine vision system in communication with said process controller to monitor fasteners for conformance with predetermined inspection criteria, said predetermined inspection criteria comprising the number of threads on the fastener, the location of threads on the fastener, the orientation or pitch of the threads on the fastener, the amount of coating coverage on the fastener, and the location of coating on the fastener; and said process controller upon detecting a fastener which fails to meet said inspection criteria provides a signal which causes the detected fastener to be directed to a preselected location while allowing fastener processing to continue.

24. The apparatus of claim 23, wherein said fasteners are separated into at least three locations: a first location for purged fasteners, a second location for fasteners which fail to conform to said inspection criteria; and a third for fasteners meeting said inspection criteria.

25. The method of claim 23, wherein said process controller provides a signal halting fastener processing when the number of fasteners failing to meet said inspection criteria exceeds a predetermined number.

* * * * *